US010980356B2

(12) United States Patent
Zhang et al.

(10) Patent No.: US 10,980,356 B2
(45) Date of Patent: Apr. 20, 2021

(54) TRAVEL BED

(71) Applicant: Goodbaby Child Products Co., Ltd., Jiangsu (CN)

(72) Inventors: Xingrong Zhang, Jiangsu (CN); Fusheng Ma, Jiangsu (CN)

(73) Assignee: GOODBABY CHILD PRODUCTS CO., LTD., Kunshan (CN)

( * ) Notice: Subject to any disclaimer, the term of this patent is extended or adjusted under 35 U.S.C. 154(b) by 466 days.

(21) Appl. No.: 15/509,070

(22) PCT Filed: Oct. 12, 2015

(86) PCT No.: PCT/CN2015/091745

§ 371 (c)(1),
(2) Date: Mar. 6, 2017

(87) PCT Pub. No.: WO2016/058505

PCT Pub. Date: Apr. 21, 2016

(65) Prior Publication Data

US 2017/0280892 A1 Oct. 5, 2017

(30) Foreign Application Priority Data

Oct. 17, 2014 (CN) ..... 201410553161.3
Apr. 21, 2015 (CN) ..... 201510190411.6
Jun. 1, 2015 (CN) ..... 201520364150.0

(51) Int. Cl.
*A47D 13/06* (2006.01)
*A47D 9/00* (2006.01)
(Continued)

(52) U.S. Cl.
CPC ..... *A47D 13/063* (2013.01); *A47D 9/005* (2013.01); *A47D 13/02* (2013.01); *B68G 5/00* (2013.01);
(Continued)

(58) Field of Classification Search
CPC .... A47D 13/06; A47D 13/066; A47D 13/068; A47D 13/063; A47D 13/02; A47D 13/00;
(Continued)

(56) References Cited

U.S. PATENT DOCUMENTS 3,119,124 A * 1/1964 Krauss ..... A47D 13/063 5/99.1
5,353,451 A * 10/1994 Hsiung ..... A47D 13/063 16/325
(Continued)

FOREIGN PATENT DOCUMENTS

AU 2008216264 2/2008
CA 2127632 1/1996
(Continued)

OTHER PUBLICATIONS

International search report dated Jan. 18, 2016 from corresponding application No. PCT/CN2015/091745.
(Continued)

*Primary Examiner* — Nicholas F Polito
*Assistant Examiner* — Morgan J McClure
(74) *Attorney, Agent, or Firm* — Hauptman Ham, LLP

(57) ABSTRACT

Disclosed is a travel bed comprising a bottom support, a upper surrounding frame, stand rods and fixing bases. The upper surrounding frame comprises a first surrounding rod and a second surrounding rod which are rotatably connected with a first connector. The first surrounding rod comprises a first connecting rod and a second connecting rod which are connected with a second connector, and the second surrounding rod comprises a third connecting rod and a fourth connecting rod which are connected with a third connector. The upper surrounding frame further comprises a first locking device for locking the first connecting rod and the second connecting rod, and a second locking device for locking the
(Continued)

third connecting rod and the fourth connecting rod. The first locking device is linked with the second locking device via a hauling rope.

10 Claims, 10 Drawing Sheets

(51) Int. Cl.
*A47D 13/02* (2006.01)
*B68G 5/00* (2006.01)
*A47D 7/00* (2006.01)
*A47D 13/00* (2006.01)

(52) U.S. Cl.
CPC ..... *A47D 7/00* (2013.01); *A47D 9/00* (2013.01); *A47D 13/00* (2013.01); *A47D 13/06* (2013.01); *A47D 13/068* (2013.01)

(58) Field of Classification Search
CPC . A47D 9/005; A47D 9/00; A47D 7/00; B68G 5/00
USPC ..... 160/351, 352, 353, 377; 256/25
See application file for complete search history.

(56) References Cited

U.S. PATENT DOCUMENTS 5,483,710 A * 1/1996 Chan ..... A47D 13/063 16/325
5,611,634 A * 3/1997 Wang ..... A47D 13/063 403/102
5,761,754 A * 6/1998 Cheng ..... A47D 13/063 5/98.1
5,761,755 A * 6/1998 Huang ..... A47D 13/063 16/324
5,781,944 A * 7/1998 Huang ..... A47D 13/063 5/98.1
5,857,229 A * 1/1999 Magnani, Jr. ..... A47D 13/063 16/323
5,906,014 A * 5/1999 Zhuang ..... A47D 13/063 403/102
6,202,229 B1 * 3/2001 Cheng ..... A47D 7/002 403/100
6,385,800 B1 * 5/2002 Chen ..... A47D 13/063 5/93.1
6,634,039 B1 * 10/2003 Cheng ..... A47D 13/063 5/99.1
7,661,159 B1 2/2010 Chen
7,694,361 B1 * 4/2010 Chen ..... A47D 13/063 5/98.1
2002/0170111 A1 * 11/2002 Cheng ..... A47D 13/063 5/99.1
2003/0061657 A1 * 4/2003 Longenecker ..... A47D 13/063 5/99.1
2003/0229968 A1 * 12/2003 Chen ..... A47D 13/063 16/297
2004/0071499 A1 * 4/2004 Chen ..... A47D 13/063 403/102
2004/0198518 A1 * 10/2004 Mendenhall ..... A47D 13/063 472/136
2005/0147463 A1 * 7/2005 Chen ..... A47D 13/063 403/102
2006/0021136 A1 * 2/2006 Cheng ..... A47D 7/002 5/99.1
2006/0225208 A1 * 10/2006 Chen ..... A47D 13/063 5/99.1
2007/0017025 A1 * 1/2007 Myer ..... A47D 7/002 5/99.1
2008/0189854 A1 8/2008 Thorne et al.
2009/0260184 A1 * 10/2009 Yu ..... A47D 13/063 16/232
2011/0031457 A1 * 2/2011 Thorne ..... A47D 13/063 256/25
2011/0314571 A1 12/2011 Carrington et al.
2012/0248394 A1 * 10/2012 Thorne ..... A47D 13/063 256/25
2012/0266381 A1 10/2012 Thorne et al.
2013/0074257 A1 * 3/2013 Mendes ..... F16C 11/10 5/99.1
2013/0239322 A1 9/2013 Throne et al.
2013/0239382 A1 * 9/2013 Cheng ..... A47D 7/002 29/426.1
2013/0240815 A1 * 9/2013 Wiegmann ..... A47D 13/061 256/25
2016/0338506 A1 * 11/2016 Yang ..... A47D 9/005
2017/0290444 A1 * 10/2017 Mao ..... A47D 13/06
2018/0008056 A1 * 1/2018 Yang ..... A47D 9/005

FOREIGN PATENT DOCUMENTS

CA 2678354 8/2008
CN 2116399 9/1992
CN 201061390 * 5/2008 ..... A47D 13/063
CN 101305878 11/2008
CN 101674759 3/2010
CN 102028368 4/2011
CN 202287249 7/2012
CN 103315565 9/2013
CN 103349448 10/2013
CN 203280128 11/2013
CN 203735845 7/2014
CN 203796691 8/2014
CN 104257165 1/2015
CN 104273984 1/2015
CN 204105486 1/2015
CN 204105488 1/2015
CN 104323625 2/2015
CN 104799610 7/2015
CN 204708383 10/2015
EP 2114213 11/2014
WO WO2008101016 8/2008
WO WO2012079282 6/2012
WO WO2016050128 4/2016

OTHER PUBLICATIONS

Office Action dated May 10, 2017 from corresponding application No. CN201510190411.6.
Office Action dated Aug. 28, 2017 from corresponding application No. CN201510190411.6.
Office Action dated May 5, 2016 from corresponding application No. CN201410553161.3.
Office Action dated Sep. 21, 2016 from corresponding application No. 201510190411.6.
Search Report dated Aug. 8, 2018 from corresponding application No. 15850194.0.
Search Report from corresponding application No. CN201510190411.6.

* cited by examiner

A - A

A - A

TRAVEL BED

RELATED APPLICATIONS

The present application is a National Phase of International Application Number PCT/CN2015/091745, filed Oct. 12, 2015, and claims the priority of China Application No. 201410553161.3, filed Oct. 17, 2014, and China Application No. 201510190411.6, filed Apr. 21, 2015, and China Application No. 201520364150.0, filed Jun. 1, 2015.

TECHNICAL FIELD OF THE INVENTION

The present disclosure relates to the field of children's products, in particular, to a travel bed.

BACKGROUND OF THE INVENTION

In prior art, a foldable travel bed comprises a foldable bedstead mainly comprising a bottom support, a surrounding frame and stand rods supporting between the bottom support and the surrounding frame. The whole bedstead is folded by folding the bottom support and the surrounding frame, and the foldable bottom support and surrounding frame have locking mechanisms respectively to lock at a unfolded position, the locking mechanism of the bottom support is located at a central position thereof, the locking mechanism of the surrounding frame is located on the surrounding rod of the surrounding frame. The locking mechanism of the surrounding frame is driven to be unlocked by unlocking the locking mechanism at the center of the bottom support, such that the bottom support and the surrounding frame are folded, and then the folding of the whole bedstead is achieved. The unfolding is in the same way. A structure to be unlocked or locked respectively causes a complicated structure of the travel bed in one aspect, and is very inconvenient for users to operate in another aspect.

SUMMARY OF THE INVENTION

The present disclosure is intended to provide a travel bed.

To achieve the above mentioned aim, the technical solution employed by the present disclosure is:

A travel bed, has a unfolded state and a folded state, and comprises a bottom support, a upper surrounding frame, a plurality of stand rods provided between the bottom support and the upper surrounding frame, and fixing bases provided at lower portions of the plurality of stand rods respectively, the bottom support comprising a plurality of bottom rods and a connecting base rotatably connected with ends of the plurality of bottom rods, the other ends of the bottom rods being connected with the fixing bases;

the upper surrounding frame comprises a first surrounding rod and a second surrounding rod which are rotatably connected with a first connector respectively, and an upper end of the upright rod is fixedly connected with the first connector; the first surrounding rod comprises a first connecting rod and a second connecting rod of which end portions are rotatably connected via a second connector, and the second surrounding rod comprises a third connecting rod and a fourth connecting rod of which end portions are rotatably connected via a third connector; the upper surrounding frame further comprises a first locking device for locking the first connecting rod and the second connecting rod to each other, and a second locking device for locking the third connecting rod and the fourth connecting rod to each other; the first locking device is provided on the second connector, the second locking device is provided on the third connector, and the first locking device and the second locking device are linked with each other via a hauling rope; during folding, when one of the first locking device and the second locking device is unlocked, the other locking device is unlocked simultaneously, the connecting base is driven to move upwardly by pressing the upper surrounding frame downwardly, and the upper surrounding frame, the stand rods and the bottom rods of the travel bed get close to one another; during the unfolding and folding of the travel bed, the stand rods move while keeping upright.

Further, the first locking device comprises a first locking unit for locking the first connecting rod and the second connecting rod to the second connector respectively, and a first unlocking unit for unlocking the first locking unit, the second locking device comprises a second locking unit for locking the third connecting rod and the fourth connecting rod to the third connector respectively, and a second unlocking unit for unlocking the second locking unit, two end portions of the hauling rope are connected to the first unlocking unit and the second unlocking unit respectively, and the first locking unit and the second locking unit are unlocked simultaneously when the first unlocking unit is conducted an unlocking operation.

More further, the first locking unit comprises a first swaying block of which an end portion is rotatably connected with the second connector, and a first locking block fixed on an end portion of the first connecting rod and an end portion of the second connecting rod respectively and rotatably connected with the second connector, the first swaying block and the first locking block are pressed against each other when the first locking unit is in a locked state, and the first swaying block and the first locking block are separated from each other when the first locking unit is in an unlocked state.

More further, the second locking unit comprises a second locking block fixed on an end portion of the third connecting rod and an end portion of the fourth connecting rod respectively and rotatably connected with the third connector, a second swaying block of which an end portion is rotatably connected with the second locking block, and a connecting block rotatably connected with the other end portion of the second swaying block and with the third connector respectively, the third connector, the second locking block, the second swaying block and the connecting block form a four-bar linkage mechanism, and the second locking unit is in a locked state when the four-bar linkage mechanism is at a dead point position.

More further, the first unlocking unit comprises an unlocking handle knob slidably provided on the second connector along an up-down direction, a first sliding slot provided on the unlocking handle knob and extending along the up-down direction, a second sliding slot provided on the second connector and extending along a horizontal direction, and a first pin provided on the other end portion of the first swaying block, the first sliding slot comprises a tilted slot extending along the up-down direction, and the first pin is able to slidably pass through the first sliding slot and the second sliding slot along the first sliding slot and the second sliding slot. When the unlocking handle knob slides, it drives the first pin to slide in the first sliding slot and the second sliding slot, and drives the first swaying block to rotate to press against the first locking block or be separated from the first locking block.

More further, the first sliding slot further comprises a straight slot extending along the up-down direction, and the straight slot is connected with the tilted slot, and the straight slot is located in the first sliding slot at an initial end of a sliding direction of the first pin during the unlocking of the unlocking handle knob.

More further, the second connector is provided with an unlocking handle knob able to slide along an up-down direction and a first driving part able to rotate, the second unlocking unit comprises a second driving part slidably provided on the third connector along the up-down direction, the first driving part is fixedly connected with an end portion of the hauling rope, the second driving part is fixedly connected with the other end portion of the hauling rope, and the unlocking handle knob slides to drive the first driving part to rotate and the first driving part drives the hauling rope to pull the second driving part to slide and cause the second locking unit to unlock.

More further, a second pin is provided on the unlocking handle knob and fitted with the first driving part, and the unlocking handle knob slides and drives the first driving part to rotate via the second pin.

More further, the second swaying block is fitted with the second driving part and rotatably connected with the connecting block via a third pin, the third connector is provided with a third sliding slot, the third pin is able to slidably pass through the third sliding slot along the third sliding slot, and when the second driving part slides, it drives the second swaying block to sway and the third pin to slide in the third sliding slot until the four-bar linkage mechanism passing the dead point, and the second locking unit is unlocked.

Further, the travel bed further comprises a top rod provided within the stand rod and able to slide along a length direction of the stand rod, top rod braces for connecting the top rod to the first surrounding rod and the second surrounding rod respectively, and an elastic part sleeved outside the top rod, the top rod is rotatably connected with lower end portions of the top rod braces, upper end portions of the top rod braces are rotatably connected with the first surrounding rod and the second surrounding rod, an upper end portion of the elastic part presses against the lower end portions of the top rod braces, and during unfolding the travel bed, the elastic part pushes against the lower end portions of the top rod braces upwardly, and drives the upper surrounding frame to unfold upwardly.

More further, an upper connecting block is fixed on an upper portion of the top rod, the lower end portion of the top rod brace is rotatably connected with the upper connecting block, and the upper end portion of the elastic part presses against the upper connecting block; a top rod fixing sleeve is fixedly provided on the stand rod, a lower portion of the top rod is inserted in the top rod fixing sleeve, and a lower end portion of the elastic part presses against an upper end portion of the top rod fixing sleeve.

Further, the travel bed further comprises a top rod extending along a height direction of the travel bed, and top rod braces for connecting the top rod to the first surrounding rod and the second surrounding rod respectively, an upper end portion of the top rod is rotatably connected with lower end portions of the top rod braces, and upper end portions of the top rod braces are rotatably connected with the first surrounding rod and the second surrounding rod.

More further, the travel bed further comprises a cam assembly provided on respective fixing base, the cam assembly comprises a top rod bulge fixedly connected with the bottom of the top rod, and a bottom rod recess fixedly connected to the other end portion of the bottom rod and rotatably connected with the fixing base, and the top rod bulge is accommodated in the bottom rod recess.

Due to the use of the above technical solutions, the present disclosure has the following advantages over the prior art:

the third connector in at least one other direction may be unlocked simultaneously by unlocking the second connector on the surrounding rods so as to achieve the folding of the surrounding frames, then the bottom rods and the bottom support are driven to be folded synchronously by the top rod mechanism on the stand rod, and the bedstead is folded quickly, easily and conveniently.

Wherein, 1—stand rod; 20—fixing base; 21—wheel; 3—first connecting rod; 300—first upper rod; 301—first lower rod; 31—second connecting rod; 310—second upper rod; 311—second lower rod; 32—first connector; 330—second connector; 331—first swaying block; 332—first locking block; 333—second sliding slot; 334—first elastic part; 335—first sliding slot; 335*a*—tilted slot; 335*b*—straight slot; 336—first driving part; 337—second elastic part; 338—unlocking handle knob; 340—third connector; 341—second swaying block; 342—second locking block; 343—third sliding slot; 344—connecting block; 345—third elastic part; 346—second driving part; 35—third connecting rod; 350—third upper rod; 351—third lower rod; 36—fourth connecting rod; 360—fourth upper rod; 361—fourth lower rod; 37—hauling rope; 40—bottom rod; 401—bottom rod recess; 41—upper base plate; 42—lower base plate; 43—connecting rod; 50—top rod; 501—top rod bulge; 51—top rod fixing sleeve; 52—upper connecting block; 6—top rod brace; 7—spring; 800—first pin; 801—second pin; 802—third pin; 803—fourth pin; 804—fifth pin; 805—sixth pin.

DETAILED DESCRIPTION OF EMBODIMENTS

In the following, the present disclosures are further explained combining with the accompanying drawings and embodiments:

Embodiment 1

Figure 1:
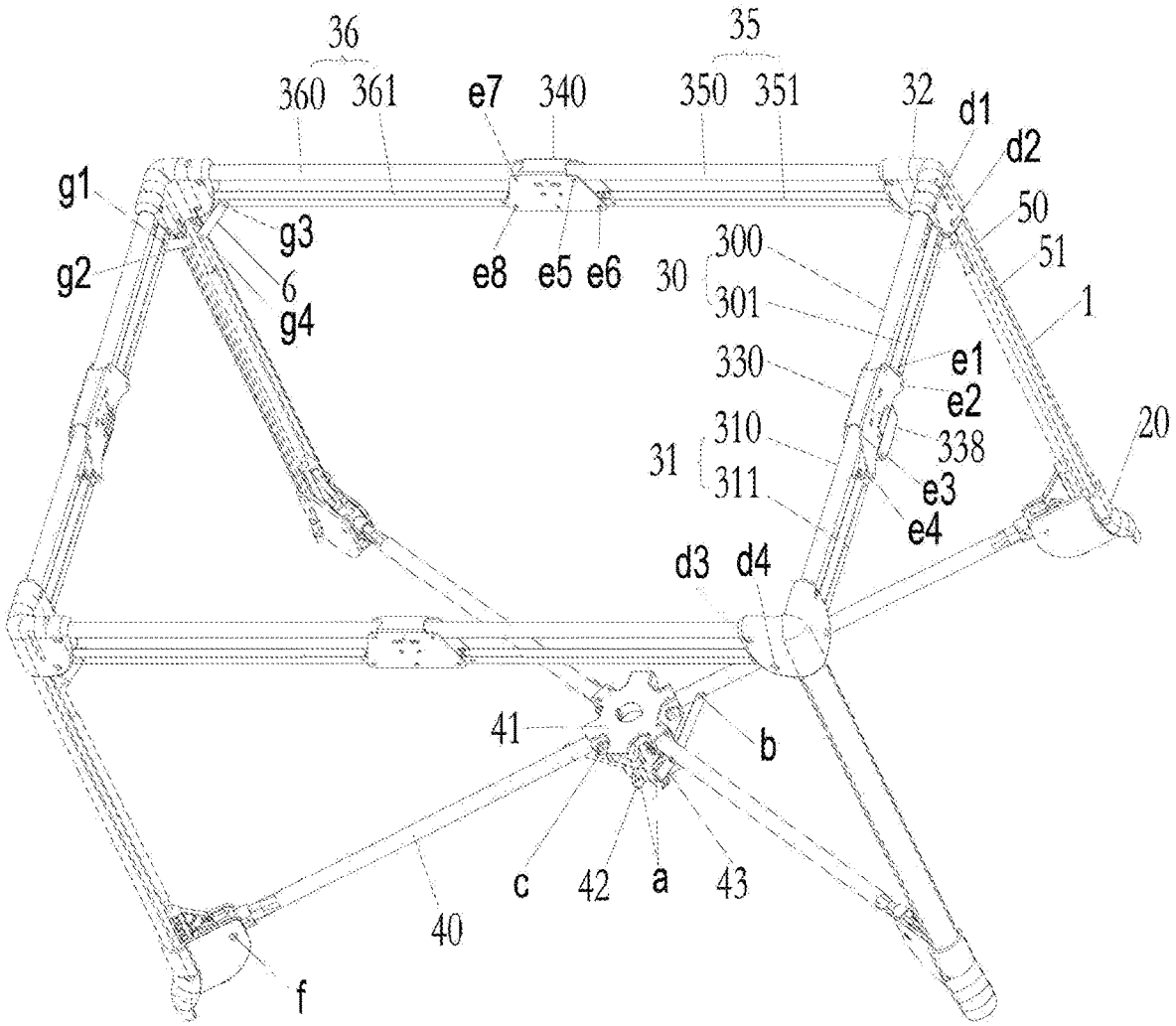
FIG. 1 is a schematic view of a travel bed in an unfolded state in Embodiment 1 of the present disclosure.

A travel bed as shown in FIG. 1, has a unfolded state and a folded state, and comprises a bottom support, a upper surrounding frame, four stand rods 1 provided between the bottom support and the upper surrounding frame, and fixing bases 20 provided at lower portions of the four stand rods 1 respectively. Each component is introduced in detail in the following:

The bottom support comprises four bottom rods 40 and a connecting base rotatably connected with end portions of the plurality of bottom rods 40, and the connecting base comprises an upper base plate 41, a lower base plate 42 slidably provided in the upper base plate 41 along a up-down direction, and a connecting rod 43; an end portion of the bottom rod 40 is rotatably connected with the upper base plate 41 via a shaft c, an end portion of the connecting rod 43 is rotatably connected with the bottom rod 40 via a shaft b, and the other end portion of the connecting rod 43 is rotatably connected with the lower base plate 42 via a shaft a.

A wheel 21 is provided on the fixing base 20.

The upper surrounding frame comprises: a first surrounding rod and a second surrounding rod of which end portions are rotatably connected with a first connector 32 via shafts d1 and d2 as well as shafts d3 and d4 respectively; the first surrounding rod comprises a first connecting rod 30 and a second connecting rod 31 of which end portions are rotatably connected with a second connector 330 via shafts e1 and e2 as well as shafts e3 and e4 respectively, the first connecting rod 30 comprises a first upper rod 300 and a first lower rod 301 which are arranged in parallel, and the second connecting rod 31 comprises a second upper rod 310 and a second lower rod 311 which are arranged in parallel; the second surrounding rod comprises a third connecting rod 35 and a fourth connecting rod 36 of which end portions are rotatably connected with a third connector 340 via shafts e5 and e6 as well as shafts e7 and e8 respectively, the third connecting rod 35 comprises a third upper rod 350 and a third lower rod 351 which are arranged in parallel, and the fourth connecting rod 36 comprises a fourth upper rod 360 and a fourth lower rod 361 which are arranged in parallel.

Figure 2:
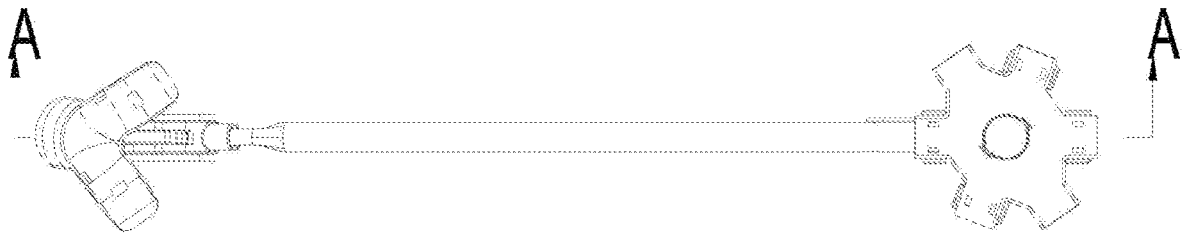
FIG. 2 is a schematic view of a part of the stand rods and the bottom support in Embodiment 1 of the present disclosure.
Figure 3:
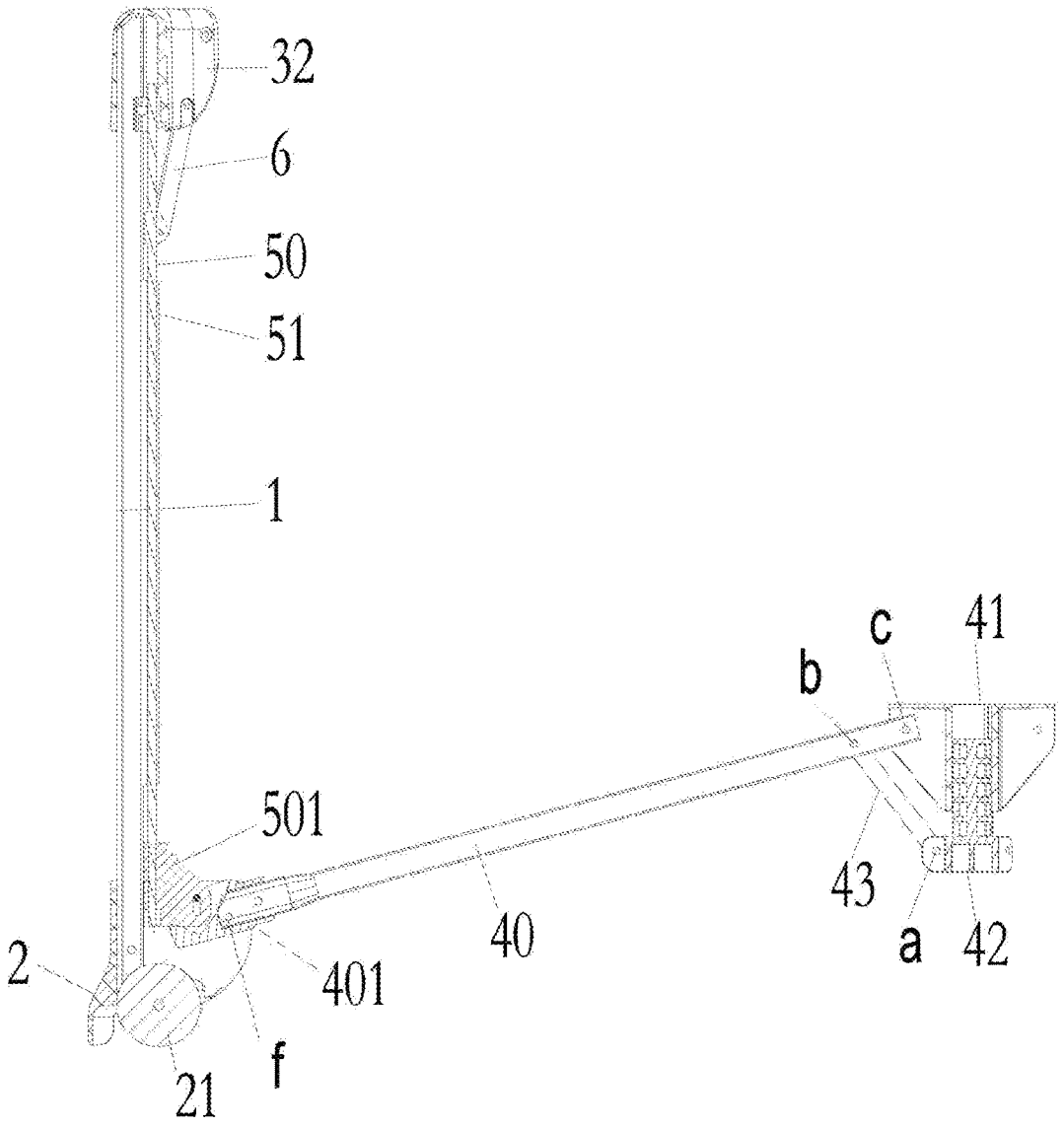
FIG. 3 is a sectional view of FIG. 2 along Line A-A.

As shown in FIGS. 2-3, the travel bed comprises a top rod 50 extending along a length direction of the stand rod 1, top rod braces 6 for connecting the top rod 50 to the first surrounding rod and the second surrounding rod respectively, wherein, an upper end portion of the stand rod 1 is fixedly connected to the first connector 32, a top rod fixing sleeve 51 is provided on the stand rod 1, and the top rod 50 is arranged in the top rod fixing sleeve 51. An upper end portion of the top rod 50 is connected with two top rod braces 6 respectively, and the two top rod braces 6 are rotatably connected with the first surrounding rod and the second surrounding rod which are connected to the same first connector 32, specifically, the first lower rod 301 and the third lower rod 351 as well as the second lower rod 311 and the fourth lower rod 361, via shafts g1 and g2 as well as shafts g3 and g4, respectively.

The travel bed further comprises a cam assembly provided on respective fixing base 20, the cam assembly comprises a top rod bulge 501 fixedly connected with the bottom of the top rod 50 and a bottom rod recess 401 fixedly connected to the other end portion of the bottom rod 40 and rotatably connected with the fixing base 20 via a shaft f, and the top rod bulge 501 is accommodated in the bottom rod recess 401.

When folding the travel bed, the first lower rod 301, the second lower rod 311, the third lower rod 351 and the fourth lower rod 361 rotate to press the top rod 50 downwardly and cause the top rod bulge 501 to press the bottom rod recess 401 downwardly such that the end of the bottom rod 40 connected with the connecting base rotates upwardly by taking the bottom rod recess 401 as a shaft, and in this way it is achieved that the stand rods 1 get close to the center and fold up in an approximate upright and parallel to each other manner.

Figure 4:
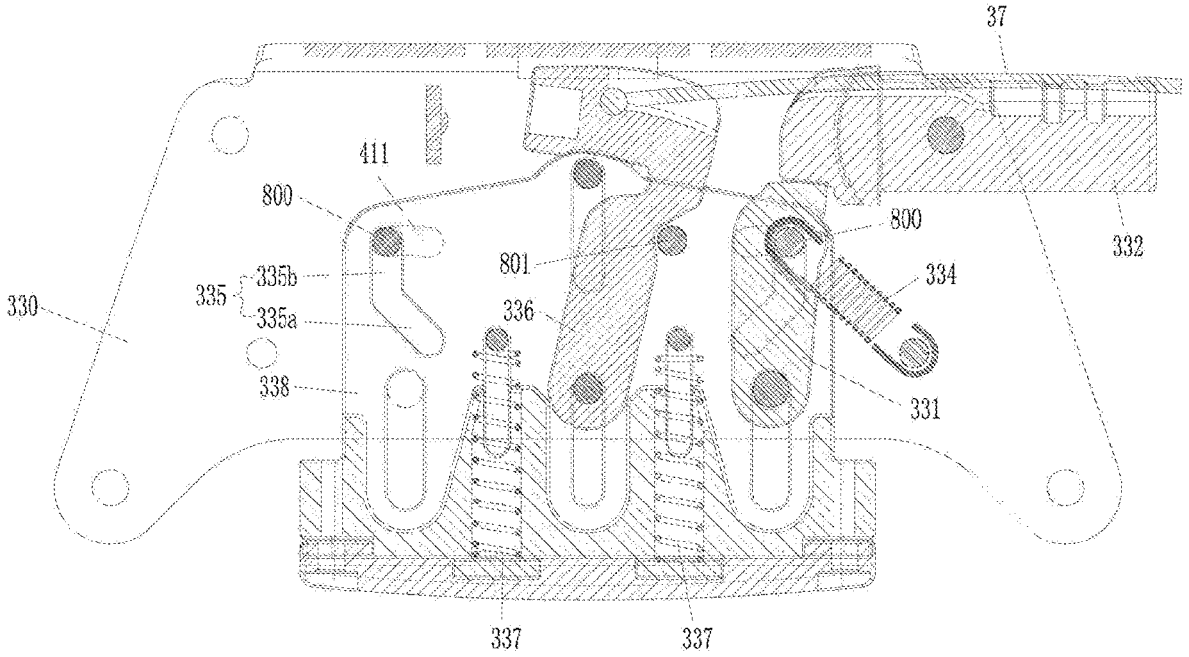
FIG. 4 is a schematic sectional view of the second connector in Embodiment 1 of the present disclosure.
Figure 5:
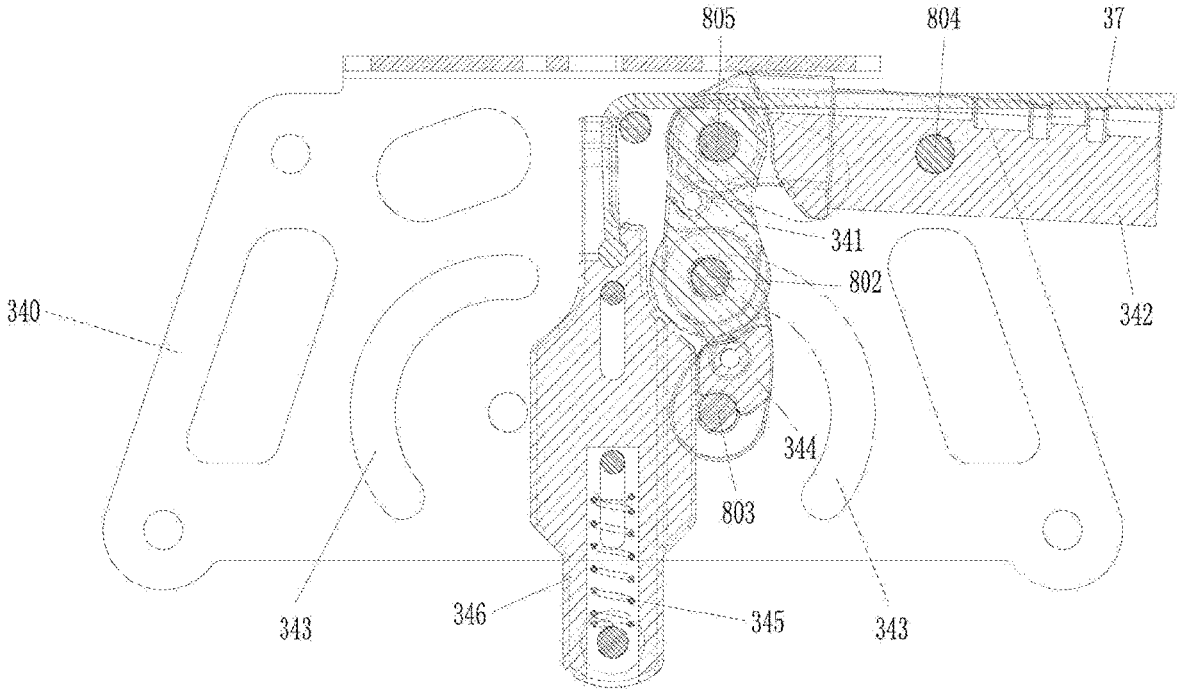
FIG. 5 is a schematic sectional view of the third connector in Embodiment 1 of the present disclosure.
Figure 6:
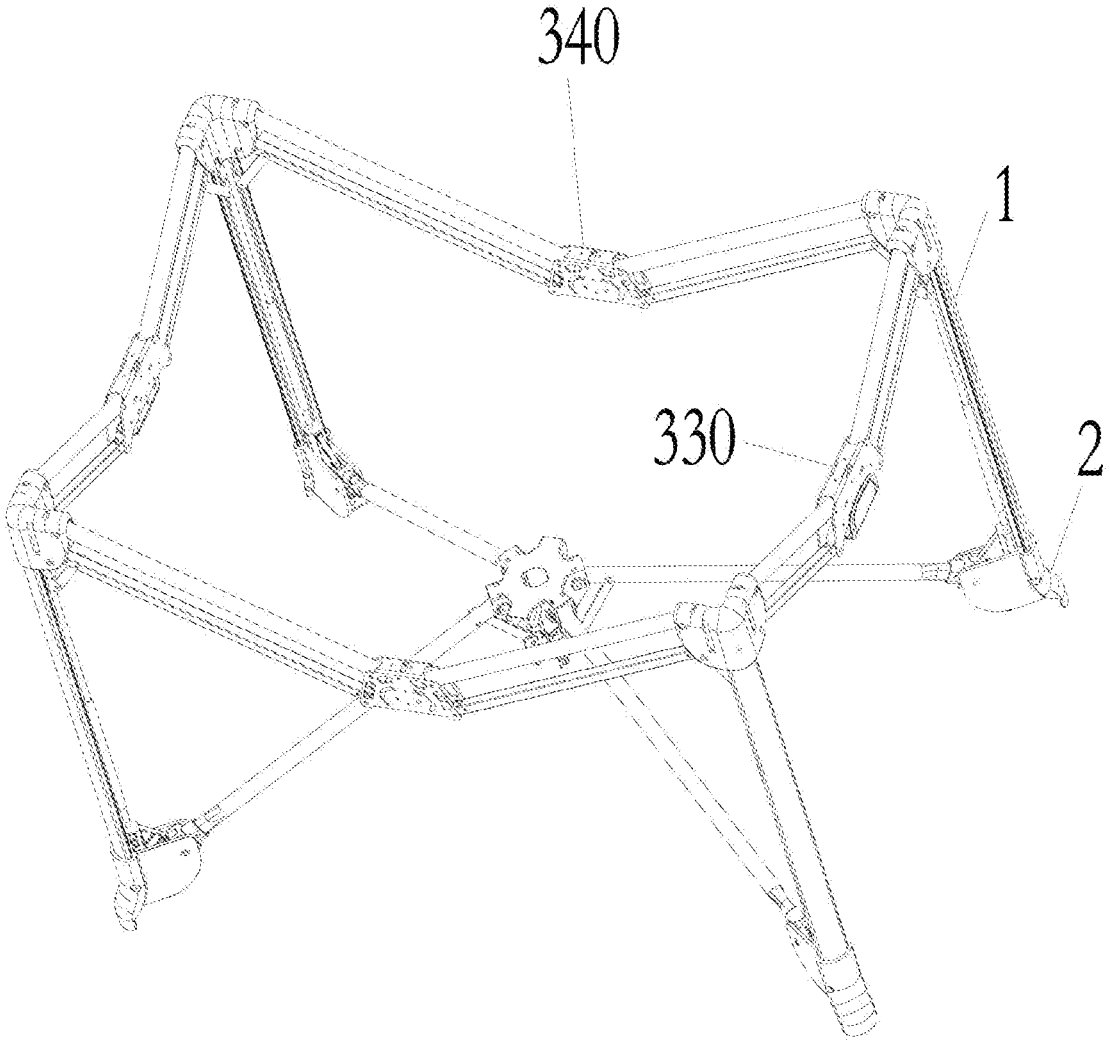
FIG. 6 is a schematic view of the travel bed in a half folded state in Embodiment 1 of the present disclosure.

As shown in FIGS. 4-5, the upper surrounding frame further comprises a first locking unit for locking the first upper rod 300 of the first connecting rod 30 and the second upper rod 310 of the second connecting rod 31 to the second connector 330 respectively, a first unlocking unit for unlocking the first locking unit, a second locking unit for locking the third upper rod 350 of the third connecting rod 35 and the fourth upper rod 360 of the fourth connecting rod 36 to the third connector 340 respectively, and a second unlocking unit for unlocking the second locking unit, the first unlocking unit and the second unlocking unit are linked to each other via a hauling rope 37, and the first locking unit and the second locking unit are unlocked simultaneously when one of the first unlocking unit and the second unlocking unit is conducted an unlocking operation.

Referring to FIG. 4, the first locking unit comprises a first swaying block 331 of which an end portion is rotatably connected with the second connector 330, and a first locking block 332 fixed on an end portion of the first connecting rod 30 and an end portion of the second connecting rod 31 respectively and rotatably connected with the second connector 330, and in the present embodiment, the rotating shafts of the first locking block 332 and the second connector 330 are the above mentioned shafts e1 and e2, respectively. When the first locking unit is in a locked state, the first swaying block 331 and the first locking block 332 are pressed against each other to cause that the first locking block 332 is not able to rotate downwardly, that is, the first connecting rod 30 and the second connecting rod 31 cannot rotate with respect to the second connector 330, and when the first locking unit is in an unlocked state, the first swaying block 331 and the first locking block 332 are separated from each other, the first connecting rod 30 and the second connecting rod 31 rotates around the rotatable connecting shaft between the respective connecting rod and the second connector 330, and the first connecting rod 30 and the second connecting rod 31 can be folded. In the present embodiment, there are two sets of the first swaying blocks 331 and the first locking blocks 332, and the two sets of the first swaying blocks 331 and the first locking blocks 332 are provided on the second connector 330 symmetrically.

The first unlocking unit comprises an unlocking handle knob 338 slidably provided on the second connector 330 along an up-down direction, a first sliding slot 335 provided on each of two opposite sides of the unlocking handle knob 338 and extending along the up-down direction, a second sliding slot 333 provided on each of two opposite sides of the second connector 330 and extending along a horizontal direction, and a first pin 800 provided on the other end portion of the first swaying block 331, the first sliding slot 335 comprises a tilted slot 335*a* extending along the up-down direction, and the first pin 800 is able to slidably pass through the first sliding slot 335 and the second sliding slot 333 along the first sliding slot 335 and the second sliding slot 333. When the unlocking handle knob 338 slides, it drives the first pin 800 to slide in the first sliding slot 335 and the second sliding slot 333, and drives the first swaying block 331 to rotate to press against or be separated from the first locking block 332. In the present embodiment, when the first locking unit is locked, the first pin 800 is located at an outer end of the second sliding slot 333 and an upper end of the first sliding slot 335; when the first locking unit is unlocked, the first pin 800 is located at an inner end of the second sliding slot 333 and a lower end of the first sliding slot 335, and by pushing the unlocking handle knob 338 upwardly, the first swaying block 331 is caused to rotate and separate from the first locking block 332, and the first locking unit is in the unlocked state. The first locking unit further comprises a first elastic part 334 for driving the first swaying block 331 to return from the unlocked state to the locked state, and in the present embodiment, the first elastic part 334 employs a spring, of which two ends are connected with the second connector 330 and the first pin 800 respectively.

Referring to FIG. 5, the second locking unit comprises a second locking block 342 fixed on an end portion of the fourth connecting rod 36 and an end portion of the third connecting rod 35 respectively and rotatably connected with the third connector 340, a second swaying block 341 of which an end portion is rotatably connected with the second locking block 342, and a connecting block 344 rotatably connected with the other end portion of the second swaying block 341 and with the third connector 340 respectively, the third connector 340, the second locking block 342, the second swaying block 341 and the connecting block 344 form a four-bar linkage mechanism, and the second locking unit is in the locked state when the four-bar linkage mechanism is at a dead point position. In the present embodiment, there are two four-bar linkage mechanisms which are provided on the third connector 340 symmetrically.

In particularly, in the present embodiment, the second swaying block 341 and the connecting block 344 are rotatably connected via a third pin 802, the connecting block 344 and the second connector 340 are rotatably connected via a fourth pin 803, the second connector 340 and the second locking block 342 are rotatably connected via a fifth pin 804 (in the present embodiment, the fifth pins 804 are shafts e5 and e7), the second locking block 342 and the second swaying block 341 are rotatably connected via a sixth pin 805, the lineation of the centers of the fourth pin 803 and the sixth pin 805 forms a straight line, and when the center of the third pin 802 is located on this straight line, or when the centers of the third pin 802 and the fifth pin 804 are located at two sides of this straight line respectively, the four-bar linkage mechanism is at the dead point position, and when the center of the third pin 802 moves toward the side where the center of the fifth pin 804 is located and passes through the above mentioned straight line, the four-bar linkage mechanism passes the dead point, and the second locking unit is in the unlocked state.

Referring to FIGS. 4-5, the unlocking handle knob 338 is provided with the second connector 330 able to slide in the up-down direction and a rotatable first driving part 336. The second unlocking unit comprises a second driving part 346 slidably provided on the third connector 340 along the up-down direction, the first driving part 336 is fixedly connected with an end portion of the hauling rope 37, the second driving part 346 is fixedly connected with the other end portion of the hauling rope 37, and the hauling rope 37 is arranged in the tube cavities of the fourth connecting rod 36, the third connecting rod 35, the first connecting rod 30 and the second connecting rod 31 to result in a clean and tidy appearance of the surrounding frame. In the present embodiment, the above mentioned two four-bar linkage mechanisms are provided at the two opposite sides of the second driving part 346 symmetrically.

Further, a second pin 801 is provided with the unlocking handle knob 338, the second pin 801 is fitted with the first driving part 336, the second swaying block 341 is fitted with the second driving part 346, third sliding slots 343 are provided at two opposite sides of the third connector 340, the third sliding slots 343 are arc-shaped slots and extend along the up-down direction. The third pin 802 passes through the third slot 343 and can slide along the third slot 343, and in the present embodiment, when the second locking unit is in the locked state, the third pin 802 is at the upper end of the third slot 343, and when the second locking unit is in the unlocked state, the third pin 802 is at the lower end of the third slot 343. When the second locking unit is unlocked, during the unlocking handle knob 338 being pushed upwardly and sliding upwardly, the first driving part 336 is driven to rotate via the cooperation between the second pin 801 and the first driving part 336, rotating of the first driving part 336 tenses the hauling rope 37 tightly, the hauling rope 37 pulls the second driving part 346 to slide upwardly, and the second swaying block 341 is driven to sway by the cooperation between the second driving part 346 and the second swaying block 341, such that the third pin 802 slides in the third sliding slot 343 toward the fifth pin 804 from top to bottom, until the center of the third pin 802 slides to pass over the straight line on which the centers of the fourth pin 803 and the sixth pin 805 are located, that is, a four-bar linkage mechanism formed by the third connector 340, the second locking block 342, the second swaying block 341, and the connecting block 344 passes the dead point, then the second locking unit is unlocked, and the fourth connecting rod 36 and the third connecting rod 35 may rotate and be folded.

In order to reduce the force required for unlocking the unlocking handle knob 338, when being unlocked, the second locking unit and the first locking unit are unlocked in order, and in a specific manner: the first sliding slot 335 further comprises a straight slot **335*b* extending along the up-down direction, and the straight slot 335*b* is connected with the tilted slot 335*a*, and located in the first sliding slot 335 at an initial end of a sliding direction of the first pin 800 during the unlocking of the unlocking handle knob 338. In the present embodiment, the straight slot 335*b* is located at the upper end of the tilted slot 335*a*. When being unlocked, during the unlocking handle knob 338 being pushed upwardly and sliding, the first pin 800 slides in the straight slot 335*b*, and meanwhile, the first swaying block 331 keeps still, the first locking unit is in the locked state, and as the unlocking handle knob 338 slides upwardly, the second pin 801 and the first driving part 336 press against each other to rotate the first driving part 336, rotating of the first driving part 336 tenses the hauling rope 37 tightly, the hauling rope 37 pulls the second driving part 346 to slide upwardly, and the second swaying block 341 is driven to sway by the cooperation between the second driving part 346 and the second swaying block 341, such that the third pin 802 slides in the third slot 343, and that the four-bar linkage mechanism formed by the third connector 340, the second locking block 342, the second swaying block 341, and the connecting block 344 passes the dead point, then the second locking unit is unlocked, and after the unlocking handle knob 338 sliding upwardly to cause the first pin 800 slide from the straight slot 335*b* to the tilted slot 335*a*, the unlocking handle knob 338 keeps to slide upwardly to drive the first swaying block 331 to rotate and separate from the first locking block 332**, and then the first locking unit is unlocked.

The surrounding frame further comprises a second elastic part 337 and a third elastic part 345 for driving the unlocking handle knob 338 and the second driving part 346 to return from the unlocked state to the locked state respectively, and the second elastic part 337 and the third elastic part 338 employ springs, two ends of the second elastic part 337 are connected with the unlocking handle knob 338 and the second connector 330 respectively, and two ends of the third elastic part 345 are connected with the second driving part 346 and the third connector 340 respectively.

The unfolding and folding process of the travel bed:

When the travel bed is in the unfolded state: the first connecting rod 30, the second connecting rod 31, the third connecting rod 35 and the fourth connecting rod 36 are all in the unfolded state with respect to each other, and the first locking unit and the second locking unit are both locked.

When the travel bed is required to be folded: operating the unlocking handle knob 338 to slide upwardly with respect to the second connector 330, and pressing the second connector 330 downwardly, and under the action of the hauling rope 37, each component of the first unlocking unit and the second unlocking unit acting as described above to cause each component of the first locking unit and the second locking unit act as described above and meanwhile getting unlocked, the first connecting rod 30 (the first upper rod 300 and the first lower rod 301), the second connecting rod 31 (the second upper rod 310 and the second lower rod 311), the third connecting rod 35 (the third upper rod 350 and the third lower rod 351) and the fourth connecting rod 36 (the fourth upper rod 360 and the fourth lower rod 361) rotating and getting close to each other, and according to the description in the context, rotating of the first lower rod 301, the second lower rod 311, the third lower rod 351 and the fourth lower rod 361 causing the top rod 50 to press downwardly, and under the action of the cam assembly, the stand rod 1 getting close to the center and getting folded, such that folding the travel bed is finally achieved, and the travel bed is kept in the folded state.

When the travel bed is required to be unfolded: pressing the connecting base downwardly to unfold the bottom rod 40, and meanwhile, the surrounding frame being driven to get unfolded, and then it is achieved by locking the first locking unit and the second locking unit. Alternatively, the bedstead is unfolded by lifting the second connector 330 or the third connector 340, and then it is achieved by locking the first locking unit and the second locking unit, and during the unfolding process, there is no need to operate the unlocking handle knob 338.

Embodiment 2

As shown in FIGS. 8-13, the present embodiment differs from Embodiment 1 only by that: the top rod 50 is able to slide along the length direction of the stand rod 1, and the travel bed further comprises a spring 7 sleeved outside the top rod 50, wherein, the lower portion of the top rod 50 is inserted into the top rod fixing sleeve 51, the upper portion of the top rod 50 is fixedly provided with an angular upper connecting block 52, the top rod brace 6 is rotatably connected to the upper connecting block 52, an upper end portion of the spring 7 presses against the upper connecting block 52 and a lower end portion of the spring 7 presses against the upper end portion of the top rod fixing sleeve 51.

Figure 7:
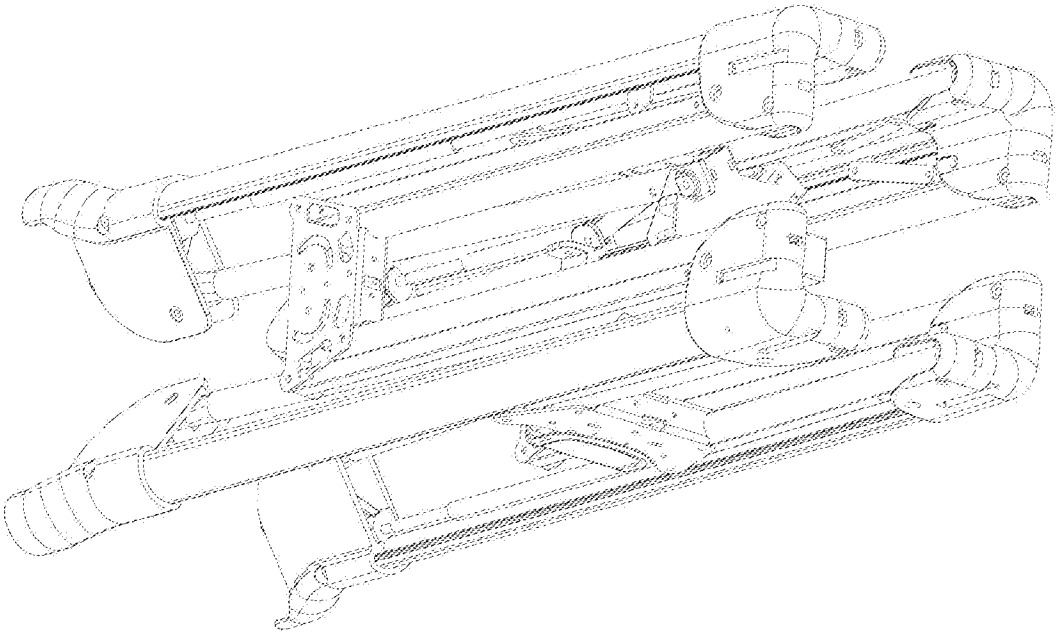
FIG. 7 is a schematic view of the travel bed in a folded state in Embodiment 1 of the present disclosure.
Figure 8:
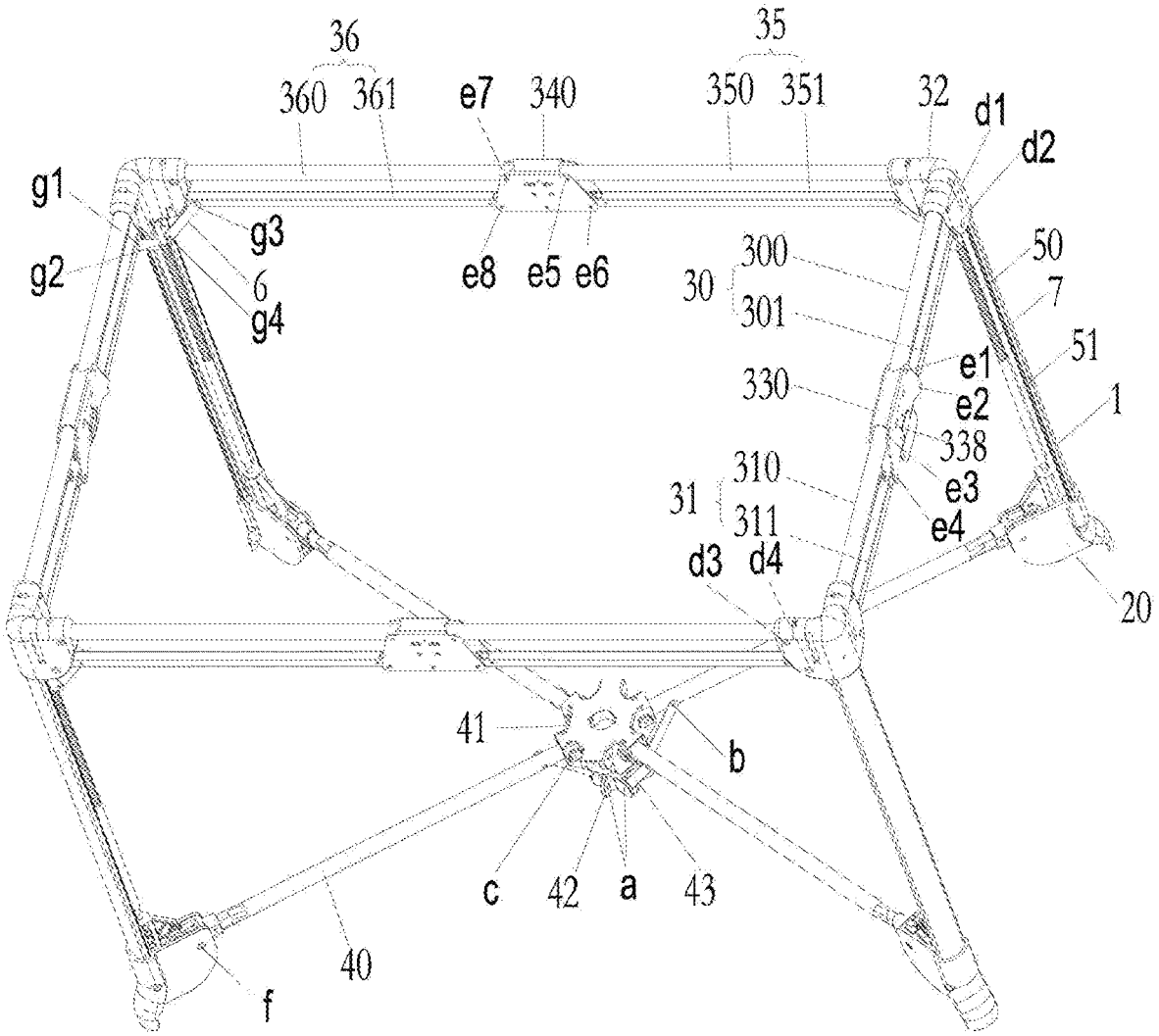
FIG. 8 is a schematic view of a travel bed in an unfolded state in Embodiment 2 of the present disclosure.
Figure 9:
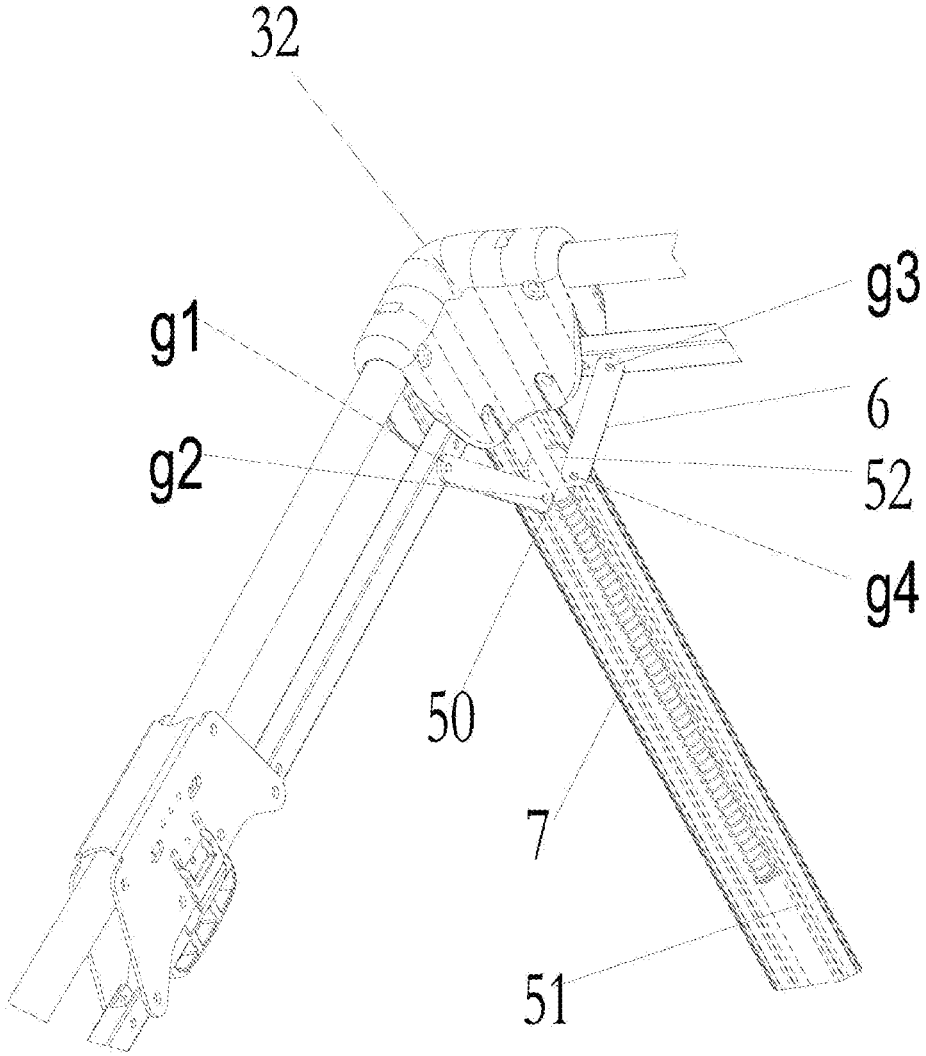
FIG. 9 is a partial enlarged view of FIG. 1.
Figure 10:
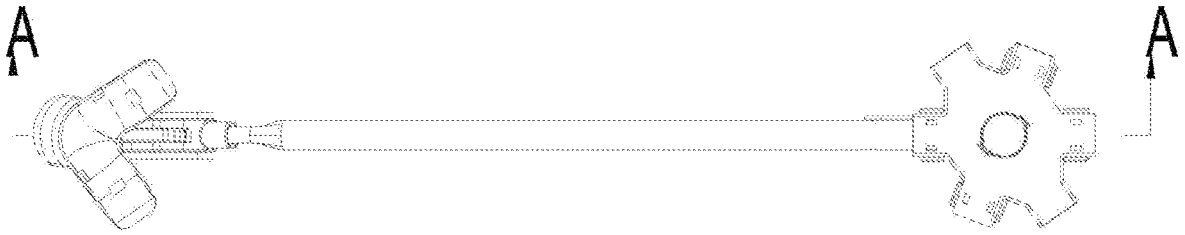
FIG. 10 is a schematic view of a part of the stand rods and the bottom support in Embodiment 2 of the present disclosure.
Figure 11:
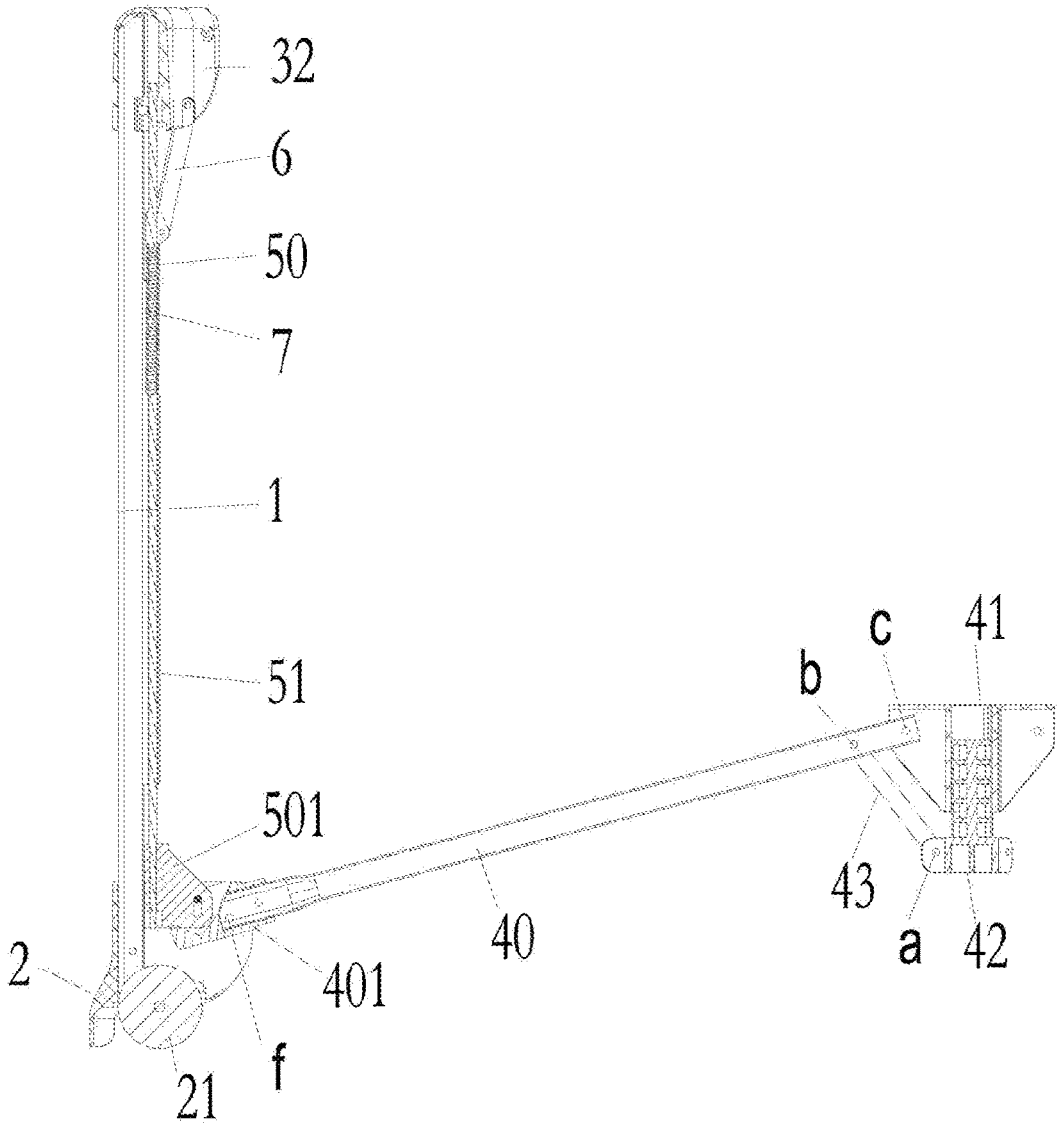
FIG. 11 is a sectional view of FIG. 10 along Line A-A.
Figure 12:
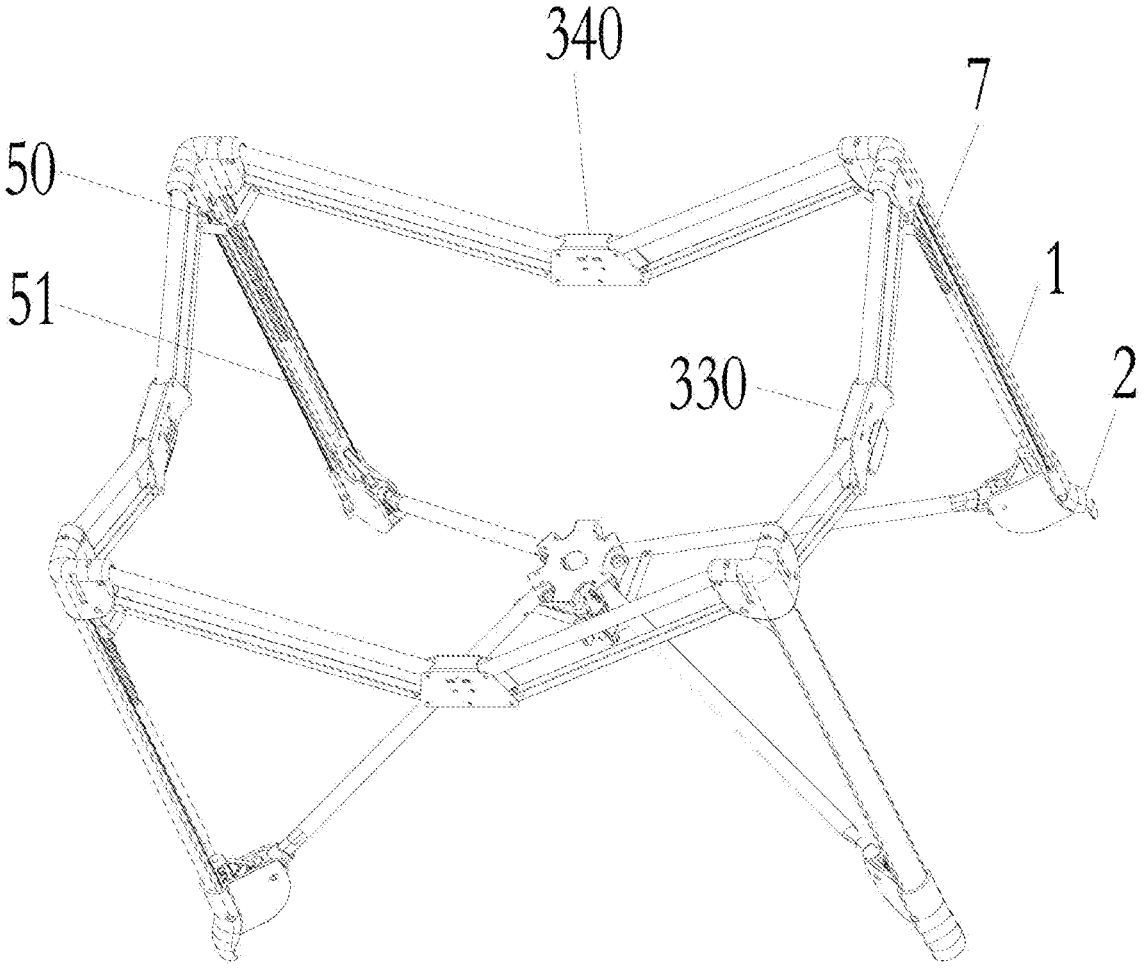
FIG. 12 is a schematic view of the travel bed in a half folded state in Embodiment 2 of the present disclosure.
Figure 13:
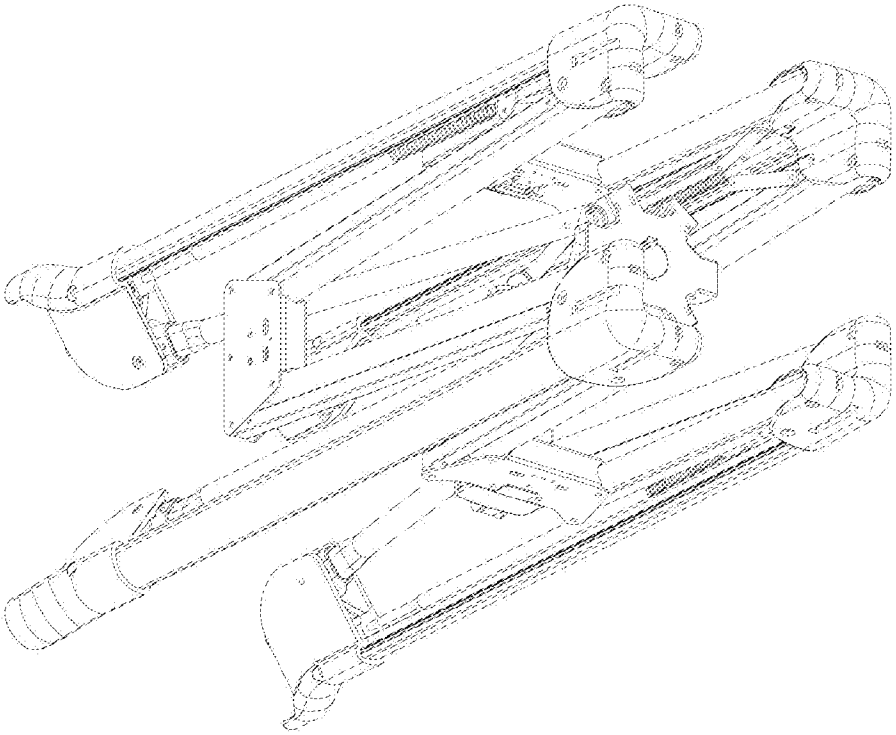
FIG. 13 is a schematic view of the travel bed in a half folded state in Embodiment 2 of the present disclosure.

When folding the travel bed, the first connecting rod 30 (the first upper rod 300 and the first lower rod 301) and the second connecting rod 31 (the second upper rod 310 and the second lower rod 311) rotate and get close to each other, the third connecting rod 35 (the third upper rod 350 and the third lower rod 351) and the fourth connecting rod 36 (the fourth upper rod 360 and the fourth lower rod 361) rotate and get close to each other, during the first lower rod 301, the second lower rod 311, the third lower rod 351 and the fourth lower rod 361 rotating, the top rod 50 is pressed downwardly and meanwhile, the top rod brace 6 compresses the spring 7 downwardly, the top rod bulge 501 presses the bottom rod recess 401 downwardly, and such that the end of the bottom rod 40 connected with the connecting base rotates upwardly by taking the bottom rod recess 401 as a shaft, and in this way it is achieved that the stand rods 1 get close to the center and fold up in an approximate upright and parallel to each other manner, and the spring 7 is in a compressed state, as shown in FIGS. 7-8, at this moment, due to that the top rod brace 6 and the top rod 50 get close to each other and are parallel to each other approximately, which corresponds to that the top rod brace 6 presses the spring 7 downwardly and uprightly, and overcomes the rotating tendency of the top rod brace 6 bringing by the elastic force of the spring 7, the travel bed keeps in the folded state. When the first connector 32 is pulled outwardly to cause the top rod brace 6 to tilt in the folded state of the travel bed, the spring 7 in the compressed state releases its elastic force and presses the top rod brace 6 upwardly via the upper portion thereof, the top rod brace 6 rotates and pushes the first lower rod 301, the second lower rod 311, the third lower rod 351 and the fourth lower rod 361 to rotate, and the upper surrounding frame is automatically opened under the action of the elastic force.

The embodiments described above are only for illustrating the technical concepts and features of the present application, and intended to make those skilled in the art being able to understand the present application and thereby implement it, and should not be concluded to limit the protective scope of this application. Any equivalent variations or modifications according to the spirit of the present application should be covered by the protective scope of the present application.

The invention claimed is:

1. A travel bed, having an unfolded state and a folded state, and comprising a bottom support, an upper surrounding frame, a plurality of stand rods provided between the bottom support and the upper surrounding frame, and fixing bases provided at lower portions of the plurality of stand rods respectively, the bottom support comprising a plurality of bottom rods and a connecting base rotatably connected with ends of the plurality of bottom rods, the other ends of the bottom rods being connected with the fixing bases, wherein, the upper surrounding frame comprises a first surrounding rod and a second surrounding rod which are rotatably connected with a first connector respectively, and an upper end of the stand rod is fixedly connected with the first connector; the first surrounding rod comprises a first connecting rod and a second connecting rod of which end portions are rotatably connected via a second connector, and the second surrounding rod comprises a third connecting rod and a fourth connecting rod of which end portions are rotatably connected via a third connector; the upper surrounding frame further comprises a first locking device for locking the first connecting rod and the second connecting rod to each other, and a second locking device for locking the third connecting rod and the fourth connecting rod to each other; the first locking device is provided on the second connector, the second locking device is provided on the third connector, and the first locking device and the second locking device are linked with each other via a hauling rope; during folding, when one of the first locking device and the second locking device is unlocked, the other locking device is unlocked simultaneously, the connecting base is driven to move upwardly by pressing the upper surrounding frame downwardly, and the upper surrounding frame, the stand rods and the bottom rods of the travel bed get close to one another; during the unfolding and folding of the travel bed, the stand rods move while keeping upright;

the first locking device comprises a first locking unit for locking the first connecting rod and the second connecting rod to the second connector respectively, and a first unlocking unit for unlocking the first locking unit, the second locking device comprises a second locking unit for locking the third connecting rod and the fourth connecting rod to the third connector respectively, and a second unlocking unit for unlocking the second locking unit, two end portions of the hauling rope are connected to the first unlocking unit and the second unlocking unit respectively, and the first locking unit and the second locking unit are unlocked simultaneously when the first unlocking unit is conducted an unlocking operation, the first locking unit comprises a first swaying block of which an end portion is rotatably connected with the second connector, and a first locking block fixed on an end portion of the first connecting rod or an end portion of the second connecting rod and rotatably connected with the second connector, the first swaying block and the first locking block are pressed against each other when the first locking unit is in a locked state, and the first swaying block and the first locking block are separated from each other when the first locking unit is in an unlocked state, the second locking unit comprises a second locking block fixed on an end portion of the third connecting rod or an end portion of the fourth connecting rod and rotatably connected with the third connector, a second swaying block of which an end portion is rotatably connected with the second locking block, and a connecting block rotatably connected with the other end portion of the second swaying block and with the third connector respectively, the third connector, the second locking block, the second swaying block and the connecting block form a four-bar linkage mechanism, and the second locking unit is in a locked state when the four-bar linkage mechanism is at a dead point position, wherein the first unlocking unit comprises an unlocking handle knob slidably provided on the second connector along an up-down direction, a first sliding slot provided on the unlocking handle knob and extending along the up-down direction, a second sliding slot provided on the second connector and extending along a horizontal direction, and a first pin provided on the other end portion of the first swaying block, the first sliding slot comprises a tilted slot extending along the up-down direction, the first pin is able to slidably pass through the first sliding slot and the second sliding slot along the first sliding slot and the second sliding slot, and when the unlocking handle knob slides, it drives the first pin to slide in the first sliding slot and the second sliding slot, and drives the first swaying block to rotate to press against the first locking block or be separated from the first locking block.

2. The travel bed according to claim 1, wherein the first sliding slot further comprises a straight slot extending along the up-down direction, and the straight slot is connected with the tilted slot, and the straight slot is located in the first sliding slot at an initial end of a sliding direction of the first pin during the unlocking of the unlocking handle knob.

3. The travel bed according to claim 1, wherein the second connector is provided with a first driving part able to rotate, the second unlocking unit comprises a second driving part slidably provided on the third connector along the up-down direction, the first driving part is fixedly connected with an end portion of the hauling rope, the second driving part is fixedly connected with the other end portion of the hauling rope, and the unlocking handle knob slides to drive the first driving part to rotate and the first driving part drives the hauling rope to pull the second driving part to slide and cause the second locking unit to unlock.

4. The travel bed according to claim 3, wherein a second pin is provided on the unlocking handle knob and fitted with the first driving part, and the unlocking handle knob slides and drives the first driving part to rotate via the second pin.

5. The travel bed according to claim 4, wherein the second swaying block is fitted with the second driving part and rotatably connected with the connecting block via a third pin, the third connector is provided with a third sliding slot, the third pin is able to slidably pass through the third sliding slot along the third sliding slot, and when the second driving part slides, it drives the second swaying block to sway and the third pin to slide in the third sliding slot until the four-bar linkage mechanism passing the dead point, and the second locking unit is unlocked.

6. The travel bed according to claim 1, wherein the travel bed further comprises a push rod provided within the stand rod and capable of sliding along a length direction of the stand rod, push rod braces for connecting the push rod to the first surrounding rod and the second surrounding rod respectively, and an elastic part sleeved outside the push rod, the push rod is rotatably connected with lower end portions of the push rod braces, upper end portions of the push rod braces are rotatably connected with the first surrounding rod and the second surrounding rod an upper end portion of the elastic part presses against the lower end portions of the push rod braces, and during unfolding the travel bed, the elastic part pushes against the lower end portions of the push rod braces upwardly, and drives the upper surrounding frame to unfold upwardly.

7. The travel bed according to claim 6, wherein an upper connecting block is fixed on an upper portion of the push rod, the lower end portion of the push rod brace is rotatably connected with the upper connecting block, and the upper end portion of the elastic part presses against the upper connecting block; a push rod fixing sleeve is fixedly provided on the stand rod, a lower portion of the push rod is inserted in the push rod fixing sleeve, and a lower end portion of the elastic part presses against an upper end portion of the push rod fixing sleeve.

8. The travel bed according to claim 6, wherein the travel bed further comprises a cam assembly provided on respective fixing base, the cam assembly comprises a push rod bulge fixedly connected with the bottom of the push rod, and a bottom rod recess fixedly connected to the other end portion of the bottom rod and rotatably connected with the fixing base, and the push rod bulge is accommodated in the bottom rod recess.

9. The travel bed according to claim 1, wherein the first connecting rod comprises a first upper rod and a first lower rod which are arranged in parallel, of which end portions are rotatably connected with the first connector and the second connector via shafts respectively;

the second connecting rod comprises a second upper rod and a second lower rod which are arranged in parallel, of which end portions are rotatably connected with the first connector and the second connector via shafts respectively;

the third connecting rod comprises a third upper rod and a third lower rod which are arranged in parallel, of which end portions are rotatably connected with the first connector and the third connector via shafts respectively;

the fourth connecting rod comprises a fourth upper rod and a fourth lower rod which are arranged in parallel, of which end portions are rotatably connected with the first connector and the third connector via shafts respectively.

10. The travel bed according to claim 1, wherein the travel bed further comprises a push rod extending along a length direction of the stand rod, and push rod braces for connecting the push rod to the first surrounding rod and the second surrounding rod respectively, an upper end portion of the push rod is rotatably connected with lower end portions of the push rod braces, and upper end portions of the push rod braces are rotatably connected with the first surrounding rod and the second surrounding rod, the push rod is arranged on the stand rod and capable of being pressed downwardly by the first surrounding rod and the second surrounding rod during folding.

* * * * *